US006252343B1

(12) United States Patent
Moon et al.

(10) Patent No.: US 6,252,343 B1
(45) Date of Patent: Jun. 26, 2001

(54) SHADOW MASK FOR CATHODE RAY TUBE AND METHOD OF MANUFACTURING SAME

(75) Inventors: Sung-hwan Moon; Dong-hee Han, both of Suwon-si; Seung-kwon Han, Seoul, all of (KR)

(73) Assignee: Samsung Display Divices Co., LTD, Kyungki-Do (KR)

( * ) Notice: Subject to any disclaimer, the term of this patent is extended or adjusted under 35 U.S.C. 154(b) by 0 days.

(21) Appl. No.: 09/235,904

(22) Filed: Jan. 20, 1999

(30) Foreign Application Priority Data

Jan. 22, 1998 (KR) ..... 98-1854

(51) Int. Cl.[7] ..... H01J 1/62
(52) U.S. Cl. ..... 313/402
(58) Field of Search ..... 313/402, 403–408

(56) References Cited

U.S. PATENT DOCUMENTS 3,777,203 * 12/1973 Yamada et al. ..... 313/402 X
5,396,146 * 3/1995 Nakamura et al. ..... 313/402
5,752,755 * 5/1998 Rho et al. ..... 313/402
5,811,918 * 9/1998 Van Den Berg et al. ..... 313/402

FOREIGN PATENT DOCUMENTS 56-121257 9/1981 (JP) .
62-223950 10/1987 (JP) .
1-276542 11/1989 (JP) .

* cited by examiner

*Primary Examiner*—Ashok Patel
(74) *Attorney, Agent, or Firm*—Christie, Parker & Hale, LLP

(57) ABSTRACT

Disclosed is a shadow mask for a cathode ray tube (CRT) and a method of manufacturing the same. The shadow mask includes a solid solution hardening material and a precipitation hardening material. The method includes the steps of heat treating a metallic plate having a plurality of apertures formed therein using a carburizing gas, and press-forming the metallic plate into a shadow mask shape.

5 Claims, 4 Drawing Sheets

SHADOW MASK FOR CATHODE RAY TUBE AND METHOD OF MANUFACTURING SAME

CROSS-REFERENCE TO RELATED APPLICATION

This application claims priority of Korean Patent Application No. 98-1854, filed Jan. 22, 1998.

FIELD OF THE INVENTION

The present invention relates to a shadow mask for a cathode ray tube (CRT) and a method of manufacturing the same. More particularly, the present invention relates to a shadow mask for a CRT and a method of manufacturing the same in which a carburization process is used to produce the shadow mask, thereby realizing improvements in tensional strength and the elongation rate.

BACKGROUND OF THE INVENTION

A conventional shadow-mask-type CRT comprises an evacuated envelope having therein a viewing screen comprising an array of phosphor elements of three different emission colors arranged in a cyclic order, means for producing three convergent electron beams directed towards the screen, and a color selection structure or shadow mask comprising a thin multi-apertured sheet of metal precisely disposed between the screen and the beam-producing means. The shadow mask shadows the screen, and the differences in convergence angles permit the transmitted portions of each beam to selectively excite phosphor elements of the desired emission color.

The conventional CRT shadow mask is typically manufactured by first coating a photoresist on a thin metal plate made of Invar or aluminum-killed (AK) steel. The plate is then exposed to light, developed and etched to form a plurality of holes therein. Thereafter, the plate formed with the holes is annealed using a heat-treating process in a hydrogen atmosphere at a high temperature, thereby removing residual stress and providing malleability to the plate. The plate is then formed into a predetermined mask shape by the use of a press, after which the plate is cleaned to remove all contaminants from the surface thereof including fingerprints, dust and other foreign substances. Finally, a blackening process is performed on the shaped plate to prevent doming of the same, thereby completing the manufacture of the shadow mask.

The shadow mask acts as a bridge between electron beams emitted from three electron guns (means for producing three convergent electron beams) and red, green and blue phosphor pixels formed on the panel, ensuring that the electron beams land on the correct phosphor pixels. Accordingly, any deviation of the shadow mask from its original position acts to mis-direct the electron beams to excite the unintended phosphor pixels.

The shadow mask can be repositioned in the CRT if the same receives external shock or vibrations, or as a result of the impact from speakers mounted in the system to which the CRT is applied. That is, if the CRT receives a substantial degree of such forces, the shadow mask moves in the CRT such that electron beams passing therethrough land on the wrong phosphor pixel, thereby deteriorating color purity. This will be described in more detail hereinbelow.

FIG. 1 shows a partial sectional view of a conventional CRT used to describe the shifting of a shadow mask caused by an external shock. As shown in the drawing, the CRT includes a panel 1, a phosphor screen 2 formed on an inner surface of the panel 1, and a shadow mask 6 fixedly suspended a predetermined distance from the phosphor screen 2 and having a plurality of apertures (not shown) formed therein. The shadow mask 6 is mounted to a side wall of the panel 1. That is, a mask frame 5 joined to a periphery of the shadow mask 6 is coupled to a spring 4, and the spring 4 is connected to a stud pin 3 protruding from the side wall of the panel 1. An electron gun 11 is mounted in a funnel (not shown) of the CRT and emits electron beams 10 in a direction toward the shadow mask 6.

When the CRT receives a substantial external shock or vibrations, the shadow mask 6 is shaken and moves from its initial position to a deviated position 7. As a result, the electron beams 10 emitted from the electron gun 11 pass through an incorrect aperture of the shadow mask 6. That is, an electron beam that is intended to pass through a predetermined aperture 8 of the shadow mask 6, comes to pass through an incorrect aperture 9 as a result of the shadow mask 6 moving to the deviated position 7. Accordingly, a position P1 on the phosphor screen 2 on which the electron beam 10 lands is altered to deviated position P2, resulting in the excitation of the wrong phosphor pixel. This causes shaking of the displayed picture, a reduction in color purity and other picture quality problems.

Furthermore, in the case where the CRT receives an extreme shock, for example if the system in which the CRT is installed is dropped, it is possible for the shadow mask 6 to become deformed. An example of this is shown in FIG. 2 in which a deformed area 12 is illustrated. When electron beams 10 pass through the deformed area 12, the above problems of shaking of the displayed picture and a reduction in color purity occur, in addition to the generation of spurious colors.

To remedy the above described problems, Japanese Patent Laid-Open No. Sho 62-223950 discloses a technique of improving tensional strength of the shadow mask by forming a plating layer thereon. However, aperture size is decreased when using this technique.

Also, Japanese Laid-Open Nos. Sho 56-121257 and Hei 1-276542 each disclose a technique of improving tensional strength of the shadow mask by heat treating the same in a gaseous atmosphere. However, in these conventional methods, the shadow mask is thermally deformed as a result of heat treating the same for long periods during the manufacturing process.

SUMMARY OF THE INVENTION

The present invention has been made in an effort to solve the above problems.

It is an object of the present invention to provide a shadow mask for a cathode ray tube (CRT) in which improvements in tensional strength and the elongation rate of the shadow mask are realized such that deformation of the shadow mask caused by external shock is prevented.

It is another object of the present invention to provide a shadow mask for a cathode ray tube (CRT) in which an improvement in the modulus of elasticity for the shadow mask is attained so that the same is not negatively influenced by external vibrations and vibrations caused by the operation of speakers in a system to which the CRT is used.

It is still another object of the present invention to provide a method of manufacturing a shadow mask for a CRT in which no thermal deformation of the shadow mask occurs during the manufacture of the same.

To achieve the above objects, the present invention provides a shadow mask for a CRT and a method manufacturing the same, the shadow mask includes a solid solution hardening material and a precipitation hardening material. The method includes the steps of heat-treating a metallic plate having a plurality of apertures formed therein using a carburizing gas, and press-forming the metallic plate into a shadow mask shape.

According to a feature of the present invention, the solid solution hardening material and the precipitation hardening material comprise carbon.

According to another feature of the present invention, the amount of carbon contained in the shadow mask is 0.01 to2.0 parts by weight based on the weight of the shadow mask.

According to yet another feature of the present invention, the shadow mask is made of a low thermal expansion material.

According to still yet another feature of the present invention, the shadow mask is made of AK steel or Invar.

According to still yet another feature of the present invention, the carburizing gas comprises an RX gas and a propane gas.

According to still yet another feature of the present invention, the temperature of the heat-treating step ranges from 600 to 1000° C.

According to still yet another feature of the present invention, the heat-treating step is conducted for a period of 0.1 to 5 hours.

BRIEF DESCRIPTION OF THE DRAWINGS

The accompanying drawings, which are incorporated in and constitute a part of the specification and, together with the description, serve to explain the principles of the invention.

DETAILED DESCRIPTION OF THE INVENTION

Figure 6:
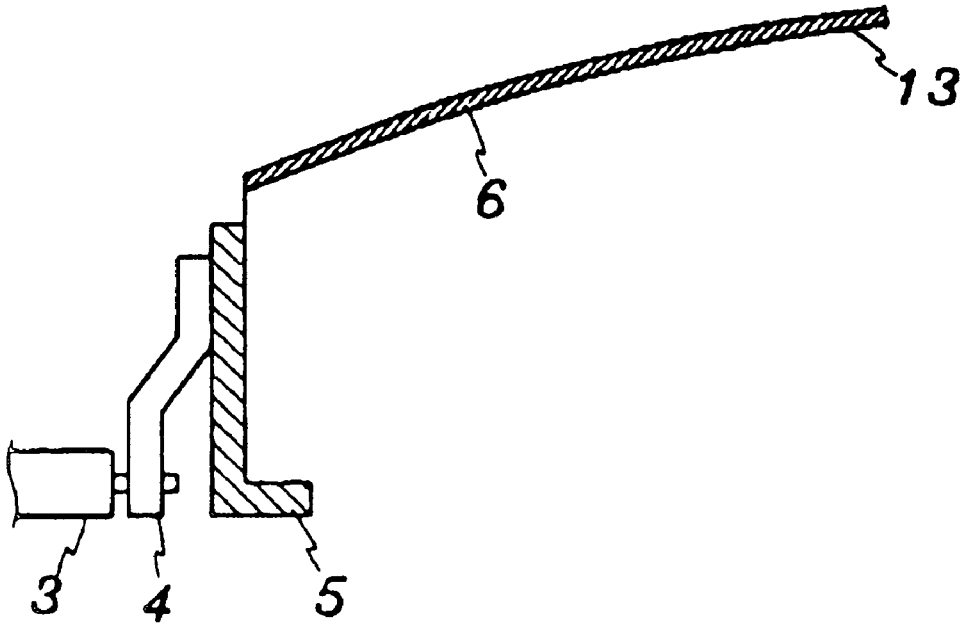
FIG. 6 depicts a shadow mask according to the invention.

A CRT shadow mask of the present invention is made of a low thermal expansion material, such as AK steel or Invar, including a solid solution hardening material and a precipitation hardening material. A shadow mask 6 according to the invention having a solid-solution and precipitation surface hardening layer 13 is shown in FIG. 6.

An inventive method of manufacturing a shadow mask for CRTs is described hereinafter.

A predetermined number of metallic plates made of a low thermal expansion material such as aluminum-killed (AK) steel or Invar, and having a plurality of apertures formed in a predetermined area to form aperture portions, is stacked and loaded on a tray. After setting a pre-heating furnace to a temperature ranging from 500 to 700° C., the tray having the stacked metallic plates thereon is placed in the pre-heating furnace.

Next, a reacting furnace is set to a temperature over 150° C., and a carburizing gas comprising an RX gas and a propane gas is fed into the reacting furnace. Here, the RX gas comprises 40% $H_2$, 40% $N_2$ and 20% CO. The carburizing gas is injected into the reacting furnace at a rate of 5 to 25 liters per minute, and the propane gas is injected therein at a rate of 1 to 10 liters per minute. Subsequently, the temperature in the reacting furnace is increased to between 600 and 1000° C., and the gaseous atmosphere therein is suitably maintained, after which the metallic plates in the pre-heating furnace are transferred to the reacting furnace.

If the temperature in the reacting furnace is maintained within the range described above, the RX gas and the propane gas decompose, thereby generating free carbons and a minute quantity of nitrogen. The free carbon atoms and nitrogen atoms effectively permeate the shadow mask. At this time, since mainly a source of free carbon is generated, the resulting effects are almost wholly those resulting from the permeation of the free carbon, rather than that of free nitrogen.

The metallic plates are heat-treated in the carburizing gas atmosphere inside the reacting furnace for between 0.1 and 5 hours. A heat treating time of less than 0.1 hours results in the insufficient reaction between the metallic plates and the gases, while it is needless to surpass 5 hours since the effects of heat-treating the metallic plates are fully realized before this time.

If the temperature of the reacting furnace is not increased to reach the lower limit of 600° C., the separation of the gases does not occur, and the heat-treating process is not effective. If the temperature exceeds 1000° C., deformation of the shadow mask may occur. Moreover, it is possible to directly place the metallic plates in the reacting furnace without first heating the same in the pre-heating furnace. However, placing the metallic plates first in the pre-heating furnace enables a more gradual increase in the temperature of the metallic plates, in addition to preventing an abrupt temperature decrease of the same after the heat-treating process.

After the carburization process is completed, the temperature in the reacting furnace is reduced to 150° C. while the atmosphere in the same is maintained in the present state. When this temperature is reached, the injection of gas into the reacting furnace is discontinued. Next, the metallic plates are removed from the reacting furnace and then press formed into the desired shadow mask shape.

Figure 1:
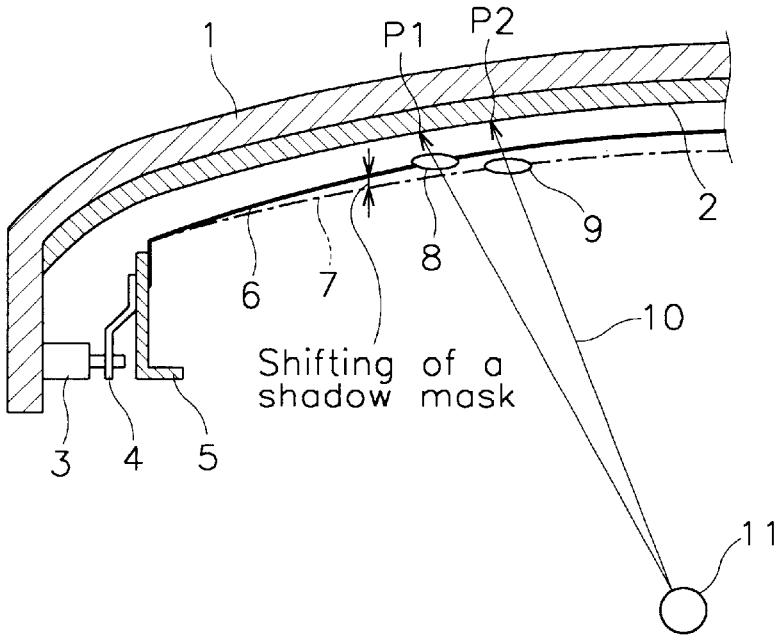
FIG. 1 is a partial sectional view of a conventional CRT used to describe shifting of a shadow mask caused by an external shock.
Figure 2:
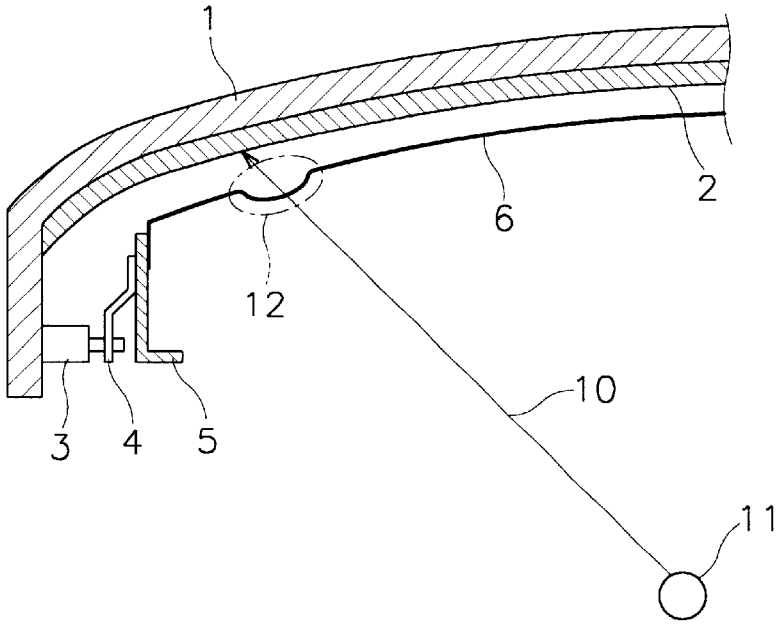
FIG. 2 is a partial sectional view of a conventional CRT used to describe damage to a shadow mask caused by an extreme external shock.
Figure 3:
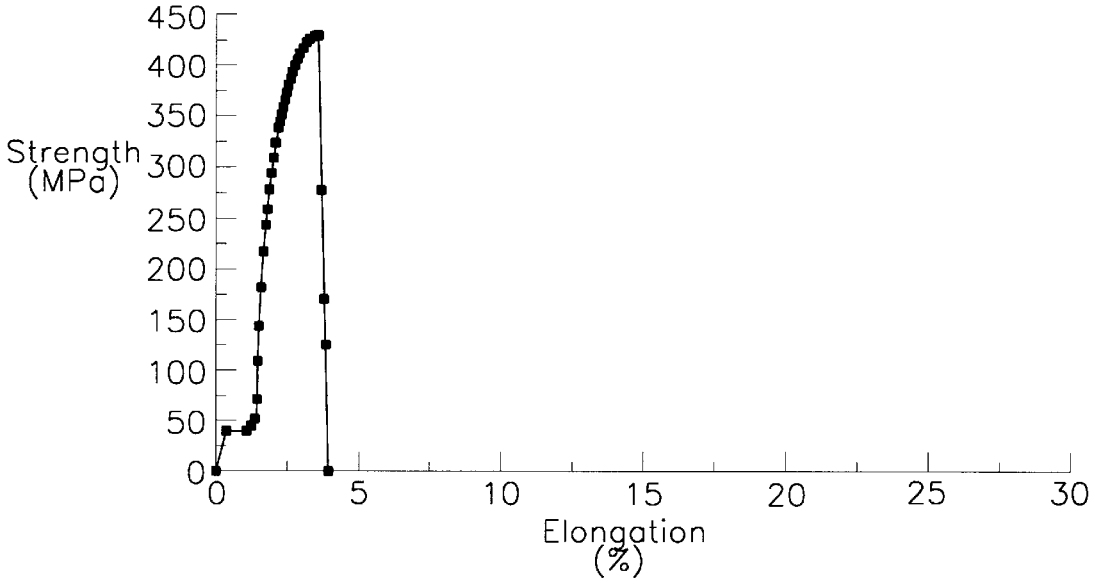
FIG. 3 is a graph illustrating the tensional strength and the elongation rate of a shadow mask manufactured without having undergone a conventional annealing process.
Figure 4:
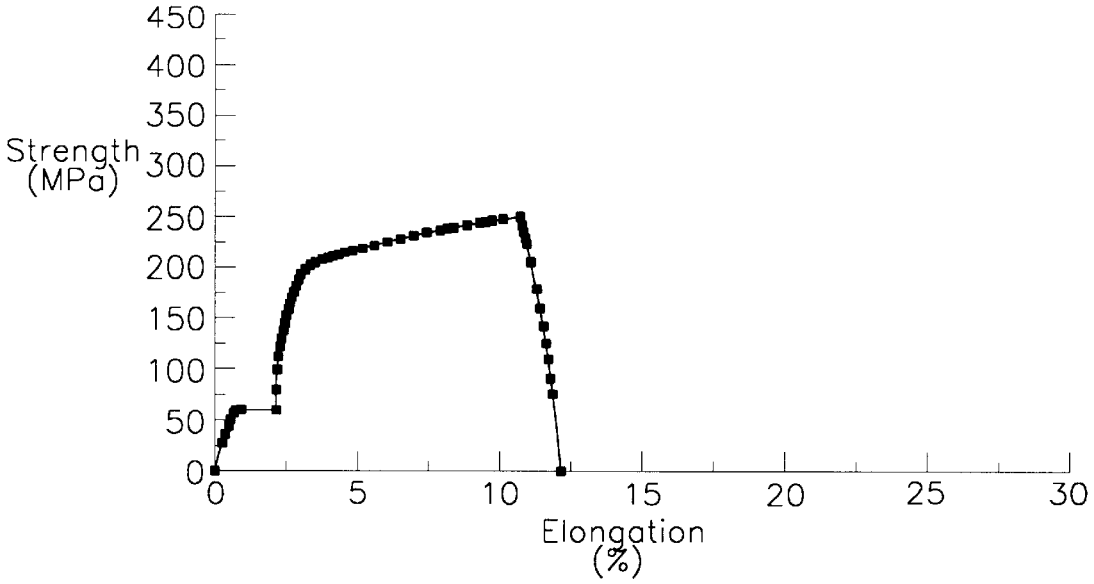
FIG. 4 is a graph illustrating the tensional strength and the elongation rate of a shadow mask manufactured after having undergone a conventional annealing process.
Figure 5:
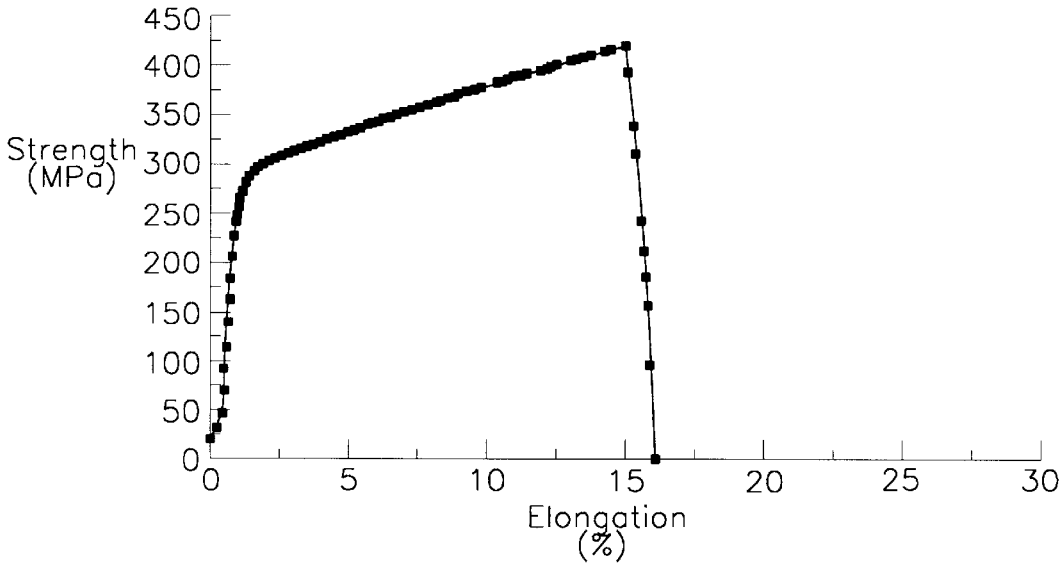
FIG. 5 is a graph illustrating the tensional strength and the elongation rate of a shadow mask manufactured using a carburization process according to a preferred embodiment of the present invention.

Because of the limited thickness of the metallic plates used to form the shadow masks, a rolling process must be undertaken a number of times during manufacture. Therefore, following the formation of the apertures in the metallic plates using an etching process, an annealing process is required before press-forming the metallic plates into the desired shape. As shown in FIG. 3, if the annealing process is not performed, although the tensional strength of the shadow mask is high, the elongation rate is low, thereby making it impossible to press-form the metallic plates into the shadow mask shape. Accordingly, it is necessary to conduct the annealing process. However, as shown in FIG. 4, annealing the metallic plates increases the elongation rate.

Therefore, in the present invention, rather than using the conventional annealing process, a carburization process is used, thereby increasing both the elongation rate and the tensional strength of the metallic plates used to manufacture the shadow masks. With regard to the carburization process, carbon monoxide (CO) is generated using RX gas and propane gas in a reaction furnace maintained at a high temperature. The carbon monoxide is permeated or diffused in the shadow masks such that a Fe—Ni—C compound or a reaction material such as $Fe_3C$ is formed as a result of the reaction between the carbon monoxide and the shadow masks. The carbon compound is employed and precipitated in a matrix of the metallic plates used to make the shadow masks, thereby hardening the same. At this time, the amount of carbon contained in the shadow mask is 0.01 to 2.0 parts by weight based on the weight of the shadow mask.

As can be seen in the graphs, the tensional strength of the shadow mask manufactured using the method of the present invention approximates that of the prior shadow mask not having undergone the annealing process and is significantly greater (roughly 100 Mpa) than the conventional annealed shadow mask. Further, the elongation rate of the inventive shadow mask is far greater than the non-annealed conventional shadow mask, and slightly improved over the annealed conventional shadow mask.

Accordingly, defects to the shadow mask occurring during the various manufacturing processes are minimized, and the shifting and deformation of the shadow mask caused by external shocks are reduced. Further, it is easier to roll-form the metallic plates used to manufacture the shadow mask after it has undergone the heat-treating process, and grains can be more evenly formed such that a sufficient elongation rate can be obtained. Additionally, since the modulus of elasticity of the inventive shadow mask is increased, shaking caused by external vibrations and vibrations generated by speakers is reduced.

The present invention is explained in more detail with reference to the following example.

EXAMPLE 1

A predetermined number of metallic plates, having a plurality of apertures formed over a predetermined area to form aperture portions, were stacked and loaded on a tray. Next, a pre-heating furnace was set and maintained at 650° C., after which the tray having the stacked metallic plates thereon was placed in the pre-heating furnace.

A reacting furnace was heated to a temperature over 150° C., and a carburizing gas comprising a RX gas and a propane gas was fed into the reacting furnace at a rate of 15 liters per minute for the RX gas and 3 liters per minute for the propane gas. Subsequently, the temperature in the reacting furnace was increased to 850° C., and the gaseous atmosphere therein was suitably maintained, after which the metallic plates in the pre-heating furnace were transferred to the reacting furnace.

The metallic plates were heat-treated in the carburizing gas atmosphere inside the reacting furnace for 1 hour, then the temperature in the reacting furnace was reduced to 150°C. while the atmosphere therein was maintained in the present state. After this temperature was reached, the injection of the gas into the reacting furnace was discontinued. Next, the metallic plates were removed from the reacting furnace, then press-formed into the desired shadow mask shape.

The amount of carbon contained in the shadow masks was found to be 0.01 parts by weight based on the weight of the shadow mask.

Although the present invention has been described in detail hereinabove, it should be clearly understood that many variations and/or modifications of the basic inventive concepts herein taught which may appear to those skilled in the present art will still fall within the spirit and scope of the present invention, as defined in the appended claims.

What is claimed is:

1. A shadow mask made of a low thermal expansion material comprising:

a solid solution hardening material comprising carbon; and a precipitation hardening material comprising carbon.

2. The shadow mask of claim 1 wherein the amount of carbon contained in the shadow mask is 0.01 to 2.0 parts by weight based on the weight of the shadow mask.

3. The shadow mask of claim 1 wherein the shadow mask is made of aluminum-killed steel.

4. The shadow mask of claim 1 wherein the shadow mask is made in invar.

5. The shadow mask of claim 1 wherein the amount of carbon contained in the shadow mask is 0.1 to 2.0 parts by weight based on the weight of the shadow mask.

* * * * *